US007316469B2

(12) United States Patent
Chikamoto et al.

(10) Patent No.: US 7,316,469 B2
(45) Date of Patent: Jan. 8, 2008

(54) INK-JET HEAD

(75) Inventors: Tadanobu Chikamoto, Nagoya (JP); Hiroshi Taira, Ichinomiya (JP); Yoshirou Kita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 11/682,395

(22) Filed: Mar. 6, 2007

(65) Prior Publication Data

US 2007/0229593 A1 Oct. 4, 2007

(30) Foreign Application Priority Data

Mar. 31, 2006 (JP) ..... 2006-097840

(51) Int. Cl.
*B41J 2/045* (2006.01)

(52) U.S. Cl. ..... 347/68

(58) Field of Classification Search ..... 347/58, 347/59, 68, 70, 71, 72, 40, 43
See application file for complete search history.

(56) References Cited

U.S. PATENT DOCUMENTS

| | | | | |
|---|---|---|---|---|
| 7,021,749 | B2 * | 4/2006 | Akahane et al. | 347/68 |
| 2003/0030704 | A1 * | 2/2003 | Sakamoto et al. | 347/68 |
| 2005/0264609 | A1 | 12/2005 | Kubo et al. | |

FOREIGN PATENT DOCUMENTS

JP 2005-343030 A 12/2005

* cited by examiner

*Primary Examiner*—Lamson Nguyen
(74) *Attorney, Agent, or Firm*—Baker Botts L.L.P.

(57) ABSTRACT

An ink-jet head includes a first passage forming member, a second passage forming member, and a circuit board. The first passage forming member has an ink inlet port, an ink outlet port, and a first ink passage extending from the ink inlet port to the ink outlet port. The first passage forming member is sandwiched between the circuit board and the second passage forming member. An electronic element is mounted on the circuit board. A projection defining a recess is formed on a surface of the first passage forming member. The electronic element is mounted on position facing the recess of the circuit board, and is received therein.

6 Claims, 13 Drawing Sheets

INK-JET HEAD

CROSS-REFERENCE TO RELATED APPLICATION

This application claims priority to and the benefit of Japanese Patent Application No. 2006-097840 filed on Mar. 31, 2006, the disclosure of which is incorporated herein by reference.

BACKGROUND OF THE INVENTION

1. Field of the Invention

The present invention relates to an ink-jet head for discharging ink onto a recording medium.

2. Description of the Related Art

Japanese Patent Unexamined Publication No. 2005-343030 discloses a head holder that includes, at its under face, an ink-jet head that discharges ink from an ink ejection port. The head holder supports a buffer tank supplying ink to the ink-jet head, a circuit board disposed above the buffer tank, and a flat cable electrically connecting a connector provided on the circuit board and the ink-jet head. On the flat cable, a driver IC is mounted. To the driver IC, signals including printing command are supplied from a control circuit electrically connected with the connector. When the signals including printing command are supplied to the driver IC, the driver IC supplies driving signals to the ink-jet head so that ink is discharged from the ink-jet head. Thus, desired images are formed on the paper.

SUMMARY OF THE INVENTION

In such a technology disclosed in Japanese Patent Unexamined Publication No. 2005-343030, the head holder includes therein space for storing a capacitor mounted on the circuit board. Since the space is formed at the side of the buffer tank, a width of the head holder is increased. In order to make the width of the head holder narrower, the capacitor may be disposed on the upper face, on which the connector is provided, of the circuit board that is overlapped in plan view with the buffer tank. However, in this case, the height of the head holder comes to be much higher. Also in the head disclosed in the Publication, the capacitor is covered only by a cover covering the head holder and above the head holder. Thus, if the cover is detached when the connector and the flat cable are connected with each other, the capacitor comes to be exposed to outside. Because of this, the capacitor is subject to direct application of external force. As a result, the capacitor is often detached from the circuit board, or the capacitor itself is often damaged.

An object of the present invention is to provide an ink-jet head capable of restricting damages and detachment of an electronic element such as a capacitor while making the same smaller.

In accordance with an aspect of the present invention, there is provided an ink-jet head including a first passage forming member, a second passage forming member, and a circuit board. The first passage forming member elongates in one direction. The first passage forming member has an ink inlet port in the vicinity of one longitudinal end thereof, an ink outlet port in the middle section in the longitudinal direction thereof, and a first ink passage extending from the ink inlet port to the ink outlet port. The ink inlet and outlet ports are open in first and second directions opposite to each other, respectively. The second passage forming member has therein a second ink passage connected to the first ink passage via the ink outlet port. The circuit board is disposed at a position where the first passage forming member is sandwiched between the circuit board and the second passage forming member with respect to the first direction. On the circuit board, an electronic element is mounted. A projection that defines a recess opened in the first direction is formed on a surface of the first passage forming member. The surface is at least between the other longitudinal end thereof and the middle section thereof and faces the circuit board. Moreover, the electronic element is mounted on position facing the recess of the circuit board, and is received therein.

In the above construction, since the electronic element mounted on the circuit board is received in the recess defined by the projection of the first passage forming member, the electronic element is surrounded by the circuit board and the first passage forming member. Thus, direct external impact is hardly applied to the electronic element, so that the electronic element is hardly detached from the circuit board, nor is damaged. Furthermore, since the electronic element is not disposed at the side of the first passage forming member, but is received in the recess formed at a position where the first ink passage of the first passage forming member is not defined, the ink-jet head comes to be smaller even in any of first and width directions.

BRIEF DESCRIPTION OF THE DRAWINGS

Other and further objects, features and advantages of the present invention will appear more fully from the following description taken in connection with the accompanying drawings, in which.

DESCRIPTION OF THE PREFERRED EMBODIMENTS

Figure 1:
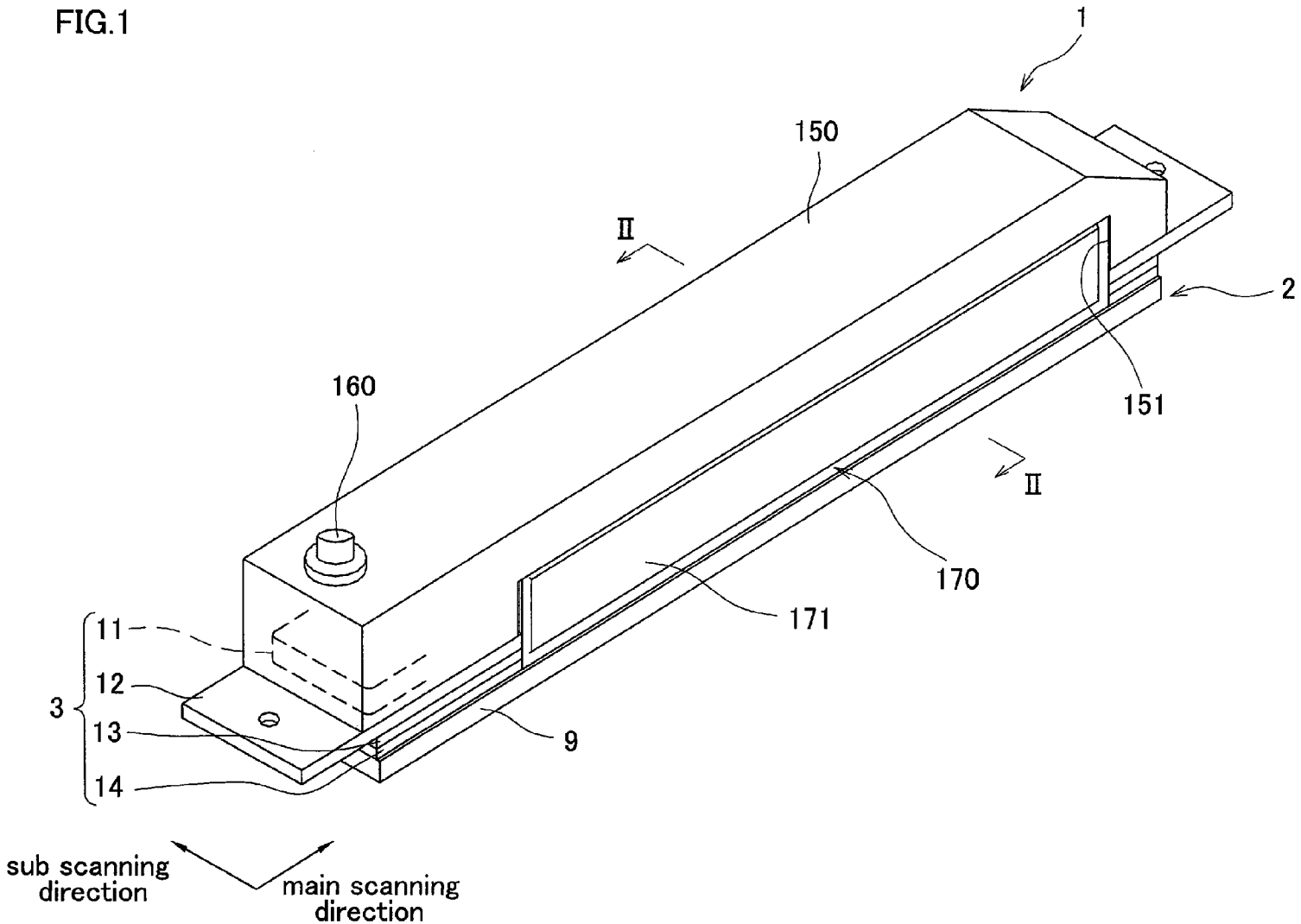
FIG. 1 is a schematic perspective view of an ink-jet head according to an embodiment of the present invention.

FIG. 1 is a schematic perspective view of an ink-jet head 1 according to an embodiment of the present invention. As shown in FIG. 1, the ink-jet head 1 has a shape elongated in the main scanning direction. The ink-jet head 1 has a head main body 2 discharging ink, a reservoir unit 3 supplying ink to the head main body 2, and a head cover 150 defining closed space above the reservoir unit 3 together with a heat sink 170, which are stacked in order from downside. In the closed space, a circuit board to be described later on which electronic elements are mounted is received. In addition, an ink supply valve 160 is disposed on the upper face of the head cover 150, and ink is supplied to the head 1 via the ink supply valve 160.

The ink-jet head 1 is adapted to image recording devices that employ an ink-jet type, such as an ink-jet printer. For example, in the case that the ink-jet head 1 is adapted to the ink-jet printer, in a plan view, the ink-jet head 1 is disposed such that longitudinal/width directions thereof follow the main/sub scanning directions, respectively. When paper is carried to a position confronting the under face of the head main body 2, ink is selectively discharged from many ejection ports 108 (See FIG. 11) formed on the under face, thereby forming images on the paper. Ink is supplied from an ink cartridge installed in an ink-jet printer to the head 1 via an ink tube (not shown) connected to the ink supply valve 160.

Figure 2:
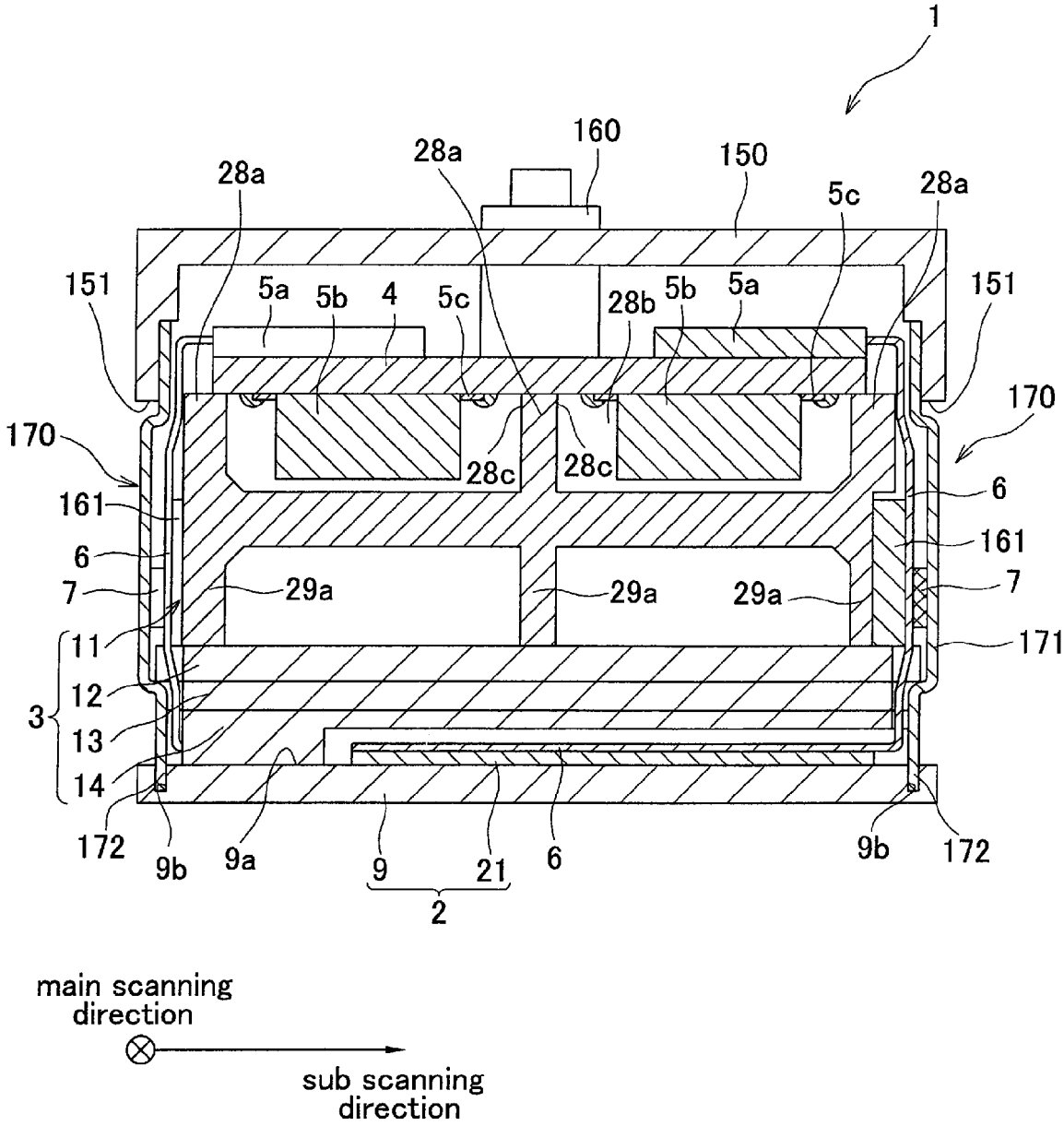
FIG. 2 is a sectional view taken along lines II-II in FIG. 1.
Figure 3:
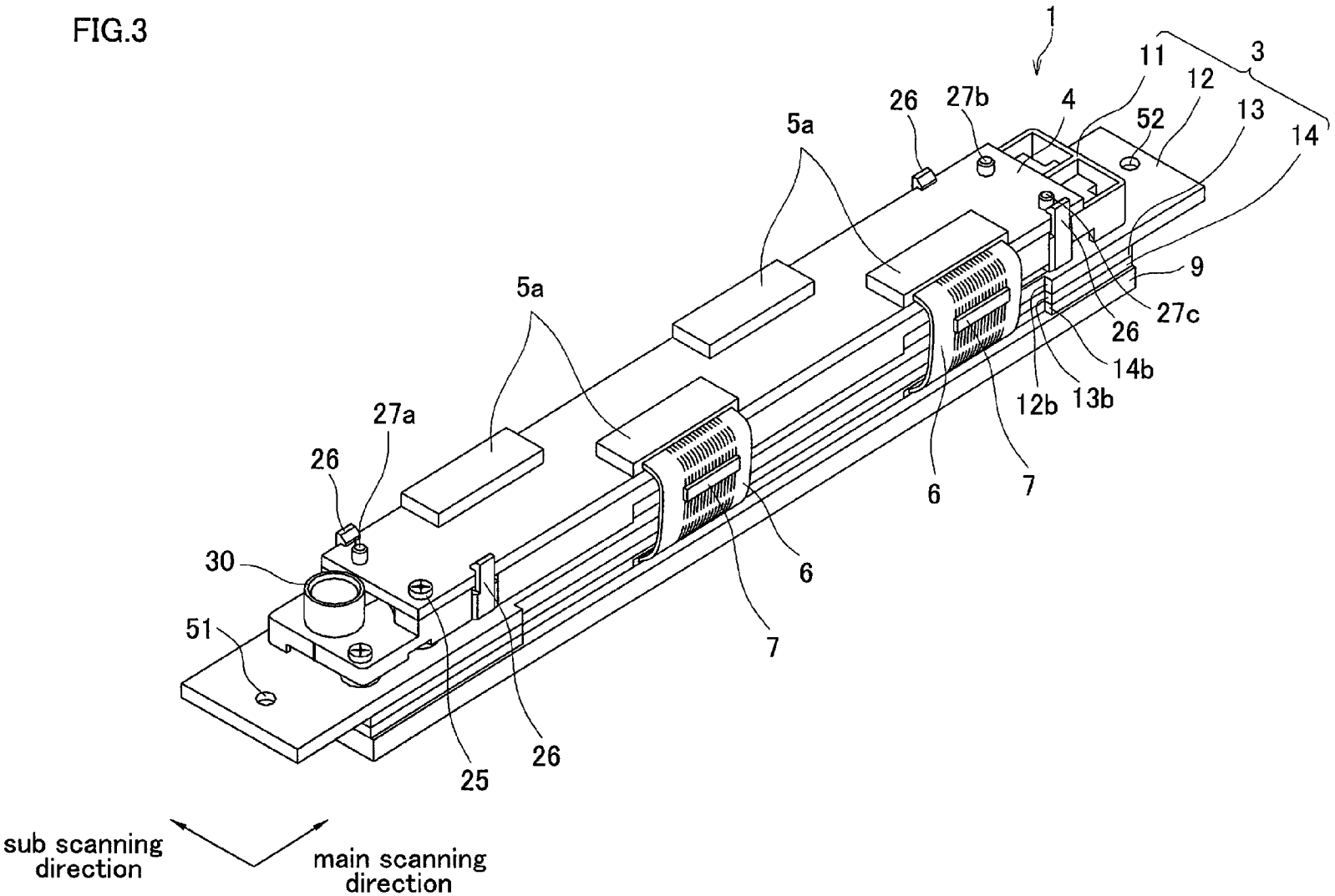
FIG. 3 is a perspective view of the internal construction of the ink-jet head illustrated in FIG. 1.

FIG. 2 is a sectional view taken along lines II-II illustrated in FIG. 1. FIG. 3 is a perspective view of the ink-jet head 1 in which the head cover 150 and the heat sink 170 are removed.

As illustrated in FIG. 3, the head main body 2 includes a passage unit 9 having a number of pressure chambers 110 (See FIG. 11) each shaped like a rhombus in plan view. On the upper face 9*a* of the passage unit 9, four actuator units 21 and the reservoir unit 3 are fixed. The actuator unit 21 selectively provides ink in the pressure chambers with ejection energy. The reservoir unit 3 and the actuator units 21 are separated in up/down directions, so that a gap is formed therebetween. The circuit board 4 is fixed above the reservoir unit 3. As shown in FIG. 3, on the upper face, i.e., the second face, of the reservoir unit 3, four connectors 5*a* are mounted. Each connector 5*a* is disposed corresponding to the single actuator unit 21. The connector 5*a* and the actuator unit 21 are connected to each other through a flexible printed circuit (FPC) 21 as a power supply member. The vicinity of one end of the FPC 6 is fixed to the upper face of the actuator unit 21. The FPC 6 is drawn out upward through gaps between the reservoir unit 3 and the actuator unit 21, and between the reservoir unit 3 and the heat sink 170, respectively. The other end of the FPC 6, as shown in FIG. 3, is connected with the connector 5*a* of the circuit board 4.

As shown in FIG. 2, on the outer face of the FPC 6, a driver IC 7 is mounted. The driver IC 7 comes to contact with the heat sink 170 as a side cover plate so that the driver IC is thermally coupled with the heat sink 170. The driver IC 7 is pressed against the heat sink 170 by an elastic member 161 attached to the side of the reservoir unit 3 (particularly, the passage forming member 11). Thus, the thermal coupling between the driver IC 7 and the heat sink 170 is made stronger and heat generated from the driver IC 7 effectively radiates outside via the heat sink 170. As a result, the driver IC 7 is effectively cooled.

As shown in FIG. 3, the circuit board 4 has the size and shape substantially identical to the passage forming member 11 of the reservoir unit 3, except that the length thereof is slightly short. The circuit board 4 is fixed to the passage forming member 11. On the under face (i.e., the first face) of the circuit board 4, i.e., the face confronting the passage forming member 11, as shown in FIG. 2, capacitors 5*b* are mounted.

Figure 4:
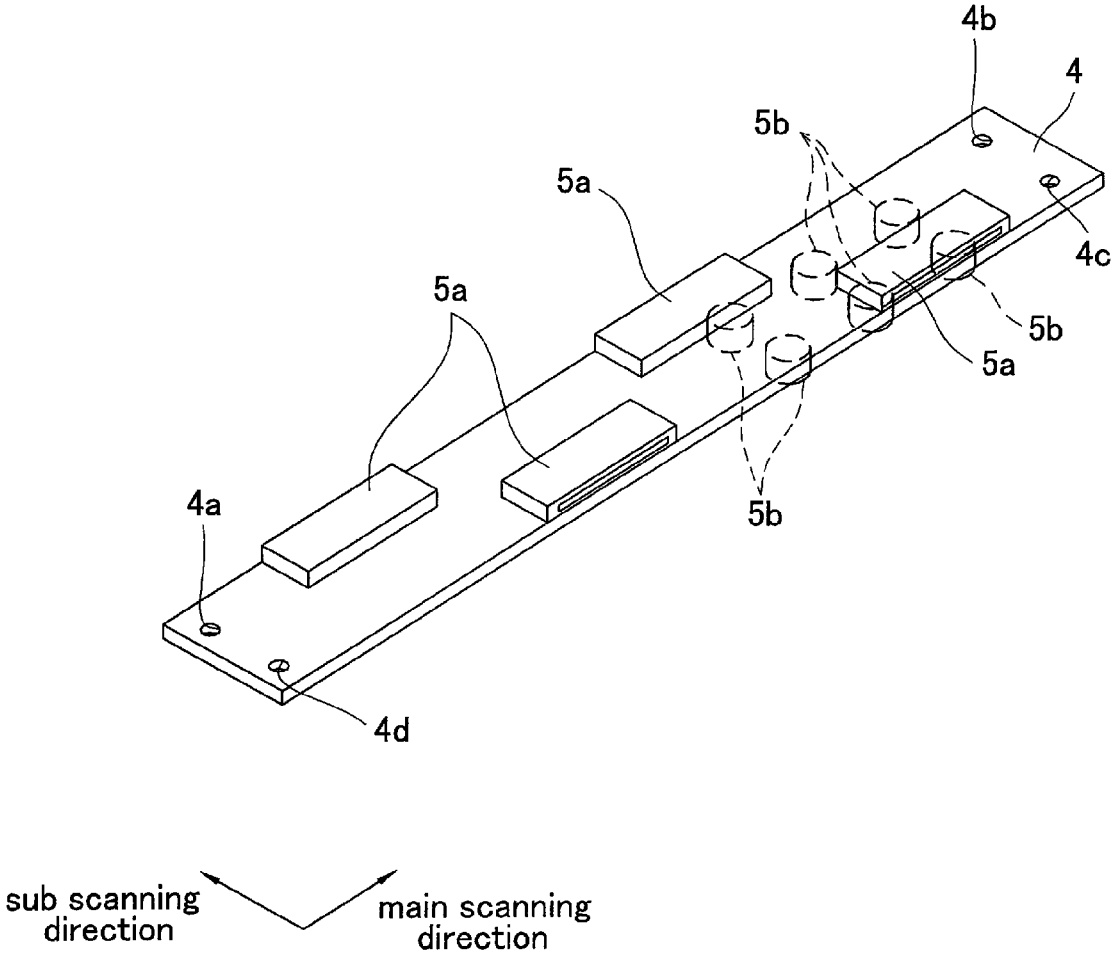
FIG. 4 is a schematic perspective view of a circuit board illustrated in FIG. 3.

FIG. 4 is a schematic perspective view of the circuit board 4. In FIG. 4, the whole construction of the circuit board 4 is illustrated. As set forth above, on the upper face of the circuit board 4, the four connectors 5*a* are arranged in zigzags in the main scanning direction. The connectors 5*a* are disposed at substantially regular intervals over the whole longitudinal length, corresponding to the installation position of the actuator unit 21. All connectors are open outside of the sub scanning direction, to which opening the other end of the FPC is connected. In addition, on the under face of the circuit board 4, six capacitors 5*b* are surface-mounted. The six capacitors 5*b* are arranged in two rows by three in the main scanning direction. In each row, the neighboring capacitors 5*b* are spaced apart at regular distances. In FIG. 4, the six capacitors 5*b* are mounted only on the right half area of the circuit board 4. The capacitor 5*b*, as shown in FIG. 2, extends, with its lead wire 5*c*, in the sub scanning direction on the under face of the circuit board 4, and an end of the lead wire 5*c* is soldered to a conductive pattern (not shown) formed on the under face of the circuit board 4. That is, the capacitor 5*b* is surface-mounted on the under face of the circuit board 4. The six capacitors 5*b* have the same protruding heights from the under face of the circuit board 4. Among the electronic elements surface-mounted on the circuit board 4, the capacitor 5*b* is the highest one. Since the capacitors 5*b* are surface-mounted on the under face of the circuit board 4, capacitors 5*b* are easily and densely surface-mounted on the circuit board 4. Moreover, the capacitors 5*b* are hardly detached from the circuit board 4.

In the circuit board 4, four through-holes 4*a* to 4*d* are formed. These through-holes 4*a* to 4*d* are formed in the vicinity of four corners of the circuit board 4. The through-holes 4*a* to 4*d* are positioning holes for positioning the circuit board 4 to the passage forming member 11. Into the through-holes 4*a* to 4*d*, as shown in FIG. 3, projections 27*a* to 27*c* of the passage forming member 11 are respectively inserted. The through-hole 4*d* is a hole provided for fixing the circuit board 4 to the passage forming member 11. The circuit board 4 and the passage forming member 11 are screw-fastened to each other by means of a screw 25 inserted through the through-holes 4*d* and 46 (See FIG. 8).

Figure 5:
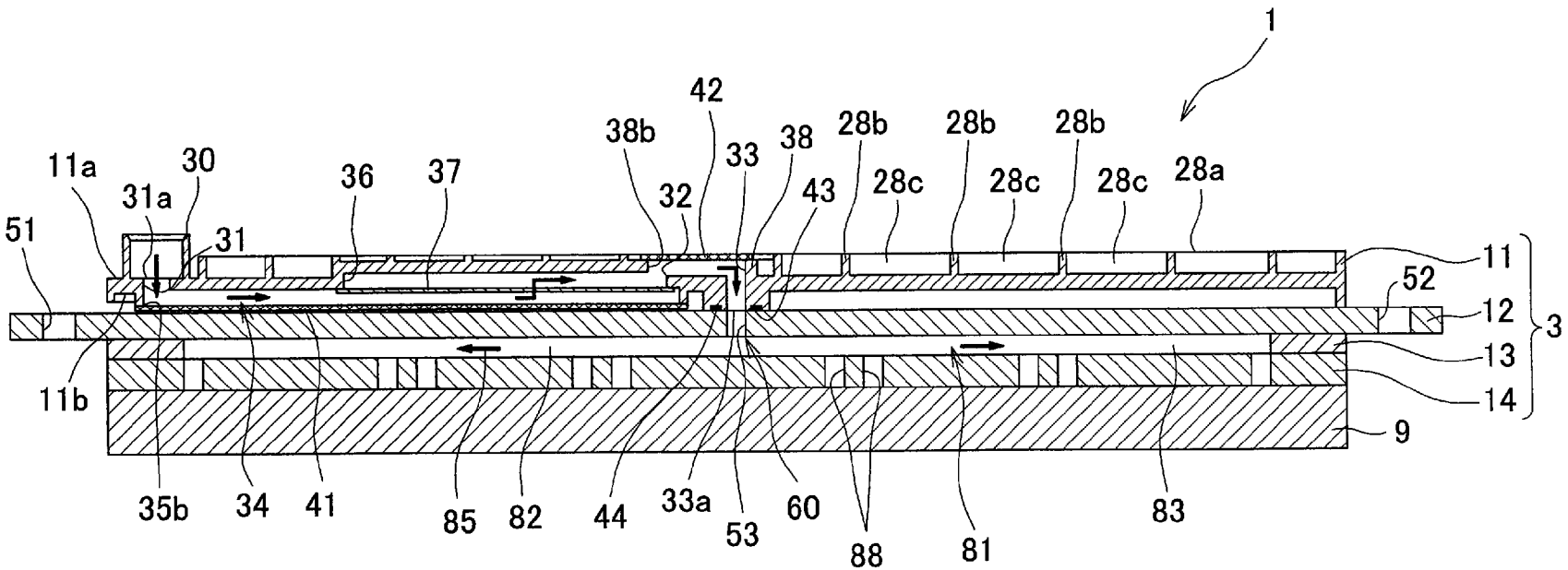
FIG. 5 is a cross-sectional view of a reservoir unit.
Figure 6A:
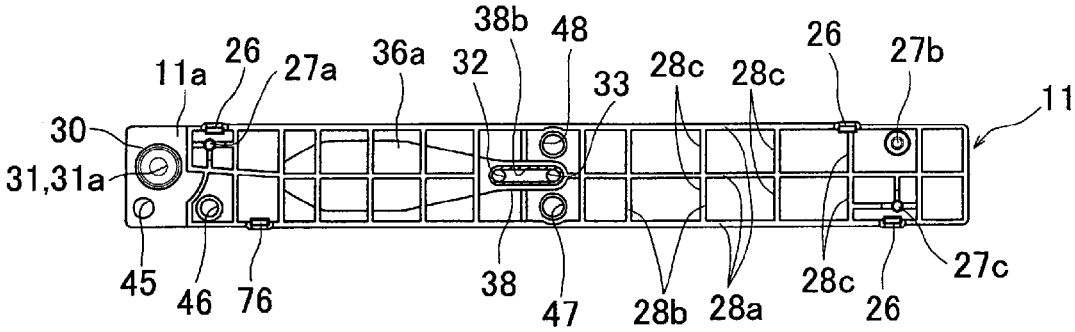
FIGS. 6A to 6E each are a plan view of the reservoir unit illustrated in FIG. 3.
Figure 6B:
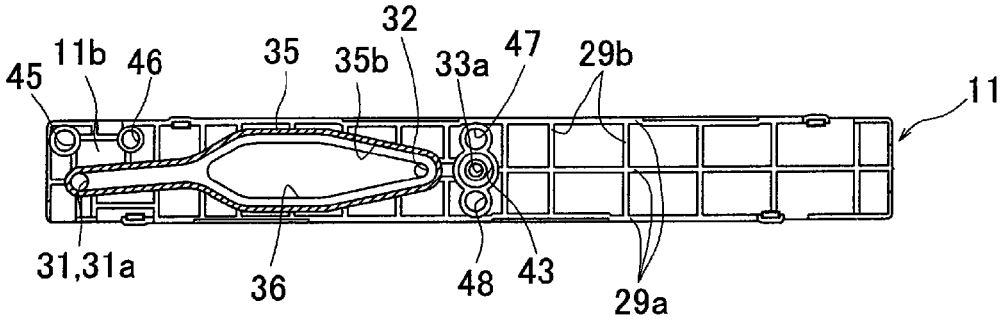
Figure 7:
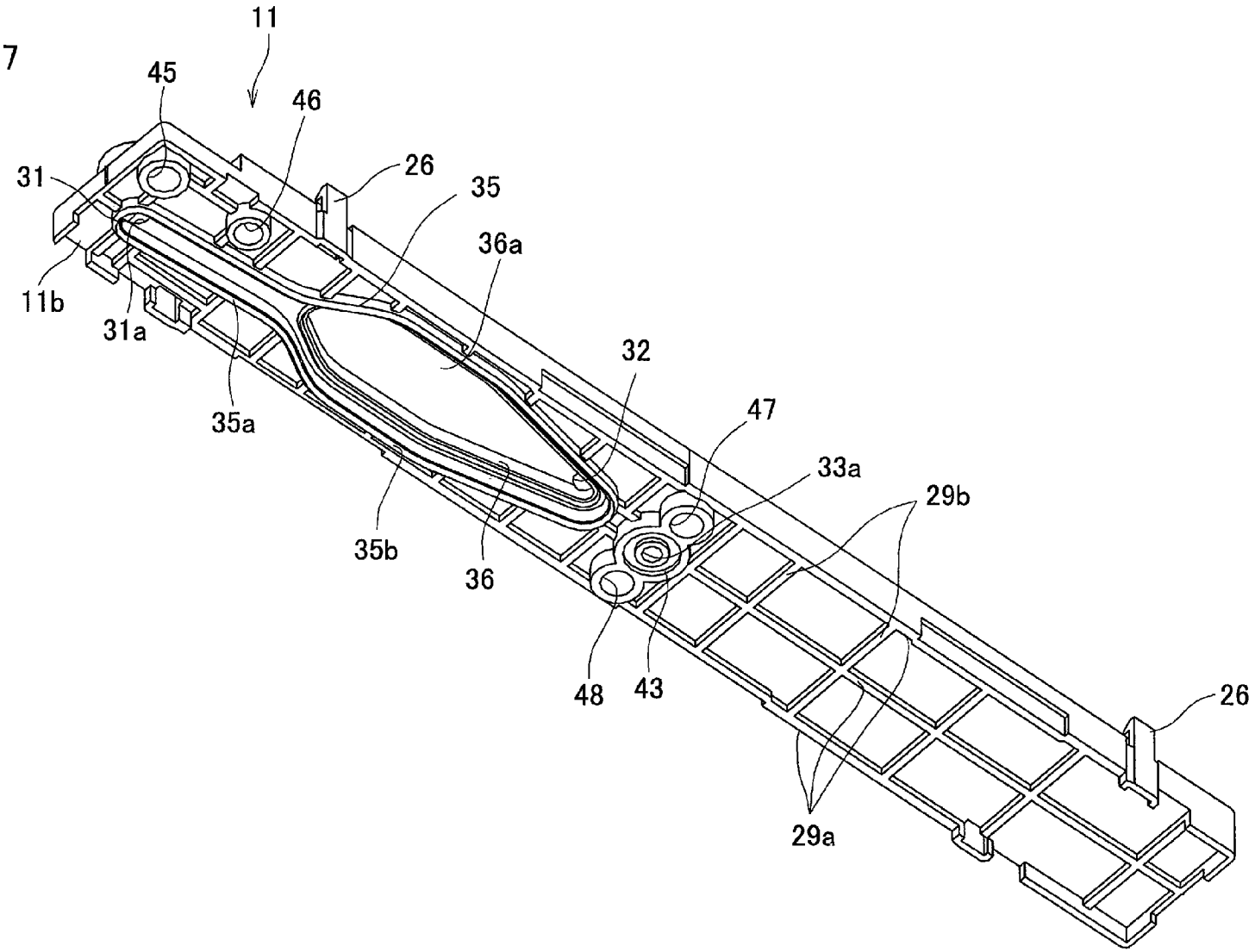
FIG. 7 is a perspective view of a passage forming member illustrated in FIGS. 6A and 6B as obliquely viewed from downward.
Figure 8:
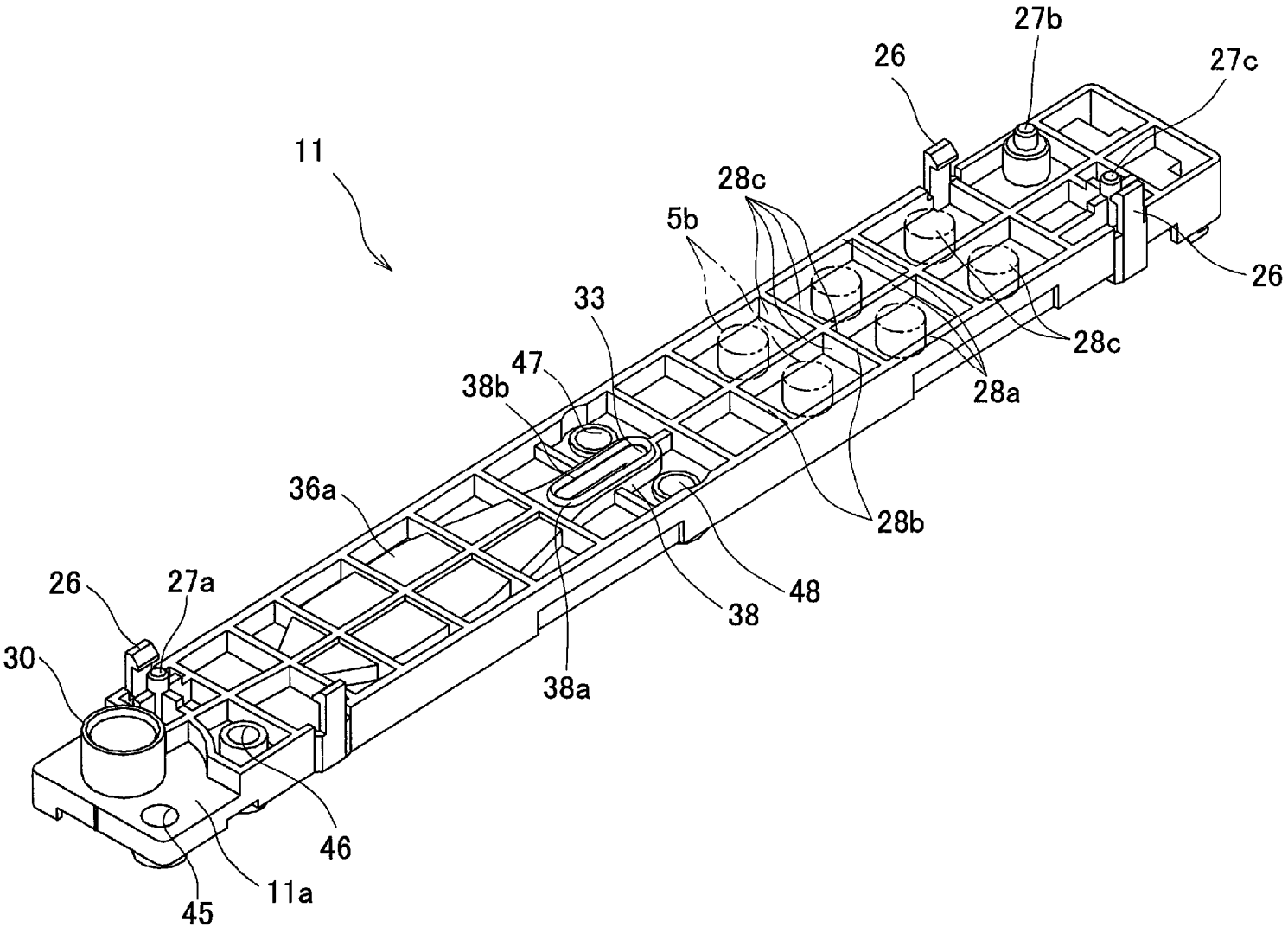
FIG. 8 is a perspective view of the passage forming member illustrated in FIGS. 6A and 6B as obliquely viewed from upward.

Next, the reservoir unit 3 fixed to the circuit board 4 will be explained additionally referring to FIGS. 5 to 8. In FIG. 5, for the convenience of explanation, perpendicularly upward scale is enlarged, and the ink passage in the reservoir unit 3, which is not generally depicted in sectional view taken along the same line, is properly illustrated. FIG. 6A is a view of the passage forming member 11 as viewed from upside, and FIG. 6B is a view of the passage forming member 11 as viewed from downside. In FIGS. 6 to 8, for easy understanding of the structure of the passage forming member 11, films 41 and 42 and a filter 37, which will be described later, are omitted.

As shown in FIG. 2, the reservoir unit 3 has a laminated structure in which four members are laminated. The reservoir unit 3 includes the passage forming member 11 as a first passage forming member, a plate 12 as a second passage forming member, and two plates 13 and 14. All of them have a rectangular plane elongated in the main scanning direction, and the most elongated plate 12 protrudes in opposite sides in the main scanning direction. The uppermost passage forming member 11 is made of synthetic resin, such as polyacetal resin or polypropylene resin. The other plates 12 to 14 are the metal plates such as stainless steel.

As shown in FIGS. 5 and 6A, the passage forming member 11 is divided into two areas, i.e., a passage area and a recess area, with reference to the middle section in the main scanning direction. In the drawings, the left half of the passage forming member 11 is the passage area. In the passage area, an ink passage 34 as a first ink passage extending from an inlet port 31*a* to an outlet port 33*a* is formed. Ink temporarily stored in the passage area is supplied to the head main body 2. In the drawings, the right half of the passage forming member 11 is the recess area. In the recess area, many recesses 28*c* defined by many ribs 28*a* and 28*b* formed as projections are formed.

As shown in FIGS. 6A and 8, a surface 11*a* of the passage forming member 11 is provided with three projections 27*a* to 27*c* and four through-holes 45 to 48. The three projections

27*a* to 27*c* are the projections for positioning the circuit board 4, and are provided at positions corresponding to the through-holes 4*a* to 4*c* of the circuit board 4. The projection 27*a* is formed in the vicinity of a joint 30. The two projections 27*b* and 27*c* are formed in the vicinity of the end opposite to the joint 30 of the passage forming member 11. The through-hole 46 is used for fixing the circuit board 4, and is provided at a position corresponding to the through-hole 4*d* of the circuit board 4. The through-hole 45 is formed in the vicinity of the corner in the passage area of the passage forming member 11. The two through-holes 47 and 48 are formed at the center of the passage forming member 11 so as to sandwich a communication hole 33.

As shown in FIGS. 6A and 8, the passage forming member 11 is provided with engaging claws 26. Two engaging claws 26 are formed at each outer side of the passage forming member 11 along its longitudinal direction. The top section of the engaging claw 26 protrudes above the rib 28*a*. The engaging claws 26 are engaged with the upper surface of the circuit board 4 disposed above the passage forming member 11, thereby fixing the circuit board 4.

The ribs 28*a* and 28*b* protrude upward, i.e., toward the circuit board 4, from the surface 11*a* in the recess area of the passage forming member 11. The rib 28*a* is a thin wall extending in the main scanning direction. The rib 28*b* is a thin wall extending in the sub scanning direction. The ribs 28*a* and 28*b* are formed along the outer edge of the passage forming member 11. The ribs 28*a* and 29*b* are crossed each other to form an annular projection. By the ribs 28*a* and 28*b* constituting the annular projection, recesses 28*c* are defined in the recess area. The recesses 28*c* all have a rectangle in plan view, and are open upward. The recesses 28*c* are adjacent to each other, while interposing the rib 28*a* or 28*b*. Here, six recesses 28*c* are respectively formed corresponding to the installation positions of the above-mentioned capacitors 5*b*. The same ribs are also formed on the passage area. By these ribs, the passage forming member 11 is made lighter without excessive degradation in stiffness.

In this embodiment, twelve recesses 28*c* are arranged six by six in two rows from the middle section toward the other longitudinal end in the passage forming member 11. The six recesses 28*c* corresponding to the capacitors 5*b* are substantially in the middle section of the row. The recess 28*c* has the size enough to receive therein the capacitor 5*b* (depicted by an alternated long short dashes line in FIG. 8) that is mounted on the under face of the circuit board 4. On the contrary, the six capacitors 5*b* have a planar shape smaller than the recess 28*c*. Thus, in plan view, the capacitor 5*b* is fully received in the recess 28*c*. The protruding heights of the ribs 28*a* and 28*b* from the surface 11*a* is slightly larger than that of the capacitor 5*b* from the circuit board 4. After the circuit board 4 is fixed to the passage forming member 11, the under face of the circuit board 4 and the top sections of the ribs 28*a* and 28*b* come to contact with each other, and the capacitor 5*b* is fully received in the recess 28*c*.

The capacitor 5*b* then is fully received in the recess 28*c*, so that the capacitor 5*b* is surrounded by the circuit board 4 and the passage forming member 11. Thus, the capacitor 5*b* subject to detachment is protected from the application of the direct external force, and is prevented from being damaged by the external force. Moreover, even after fixing the circuit board 4 in the ink-jet head 1, the capacitor 5*b* is hardly detached from the circuit board 4. Furthermore, the capacitor 5*b* is fully received in the recess 28*c*, so that the height of the ink-jet head 1 is made smaller. Since the capacitor 5*b* is highest among the electronic elements mounted on the circuit board 4, the height of the head 1 can be made smaller than the case where the capacitor 5*b* is mounted on the circuit board 4 and the other electronic elements mounted on the under face of the circuit board 4 are received in the recesses 28*c*. Moreover, since the capacitor 5*b* is disposed in the passage forming member 11, the width of the head 1 can be made smaller than the case where the capacitor 5*b* is disposed at the side of the passage forming member 11. Meanwhile, these benefits can be obtained even when only the part of the capacitor 5*b* is received in the recess 28*c*.

The protruding height of the ribs 28*a* and 28*b* from the surface 11*a* is made slightly higher than that of the capacitor 5*b* from the under face of the circuit board 4. Thus, the capacitor 5*b* is fully received in the recess 28*c*. Moreover, since the under face of the circuit board 4 and the top sections of the ribs 28*a* and 28*b* are in contact with each other, the recess 28*c* receiving therein the capacitor 5*b* is substantially completely shield from outside. Thus, it is more effectively prevented the damages and detachment of the capacitor 5*b*.

In addition, in this embodiment, the ink passage is not formed in the recess area, so that the shape and the size of the recess 28*c* can be determined with high degrees of freedom in conformity with the positions of the six capacitors 5*b* mounted on the circuit board 4.

As shown in FIGS. 5 and 6A, in the passage area of the passage forming member 11, an ink inlet hole 31 connected between the surface 11*a* and the under face 11*b* of the passage forming member 11 is formed. The ink inlet hole 31 has an upwardly opened inlet port 31*a*. The ink inlet hole 31 communicates with the internal space of the joint 30 via the inlet port 31*a*. In the vicinity of the middle of the passage forming member 11, communication holes 33 connected between the surfaces 11*a* and 11*b* of the passage forming member and communication port 32 connected between the ink inlet hole 31 and the communication hole 33 are formed. Ink introduced downward from the ink inlet hole 31 flows upward to the communication port 32, and then flows downward from the communication hole 33 to the plate 12. The passage extending from the ink inlet hole 31 to the communication hole 33 via the communication port 32 is an ink passage 34 as a first ink passage.

The joint 30 communicating with the ink inlet hole 31 has a tube shape. The joint 30 protrudes upward from the surface 11*a*, while surrounding the inlet port 31*a*. To the joint 30, the ink supply valve 160 attached to the head cover 150 is connected. Ink from the ink supply valve 160 is supplied to the ink inlet hole 31 via the joint 30.

As shown in FIGS. 6A and 8, the surface 11*a* of the passage forming member 11 is provided with an annular projection 38 having a substantially oval shape in plan view. The annular projection 38 is formed thinly and lengthily in the main scanning direction, and surrounds the communication holes 33 and the communication port 32 as viewed in plan view. The top section of the annular projection 38 is formed with a taper 38*a* tapering off toward the end thereof. The flexible film 42 is fused onto the taper 38*a*, so that a passage 38*b* of the annular projection 38 is sealed. The section surrounded by the annular projection 38 and the film 42 becomes part of the ink passage 34. A hatched region illustrated in the center of FIG. 6A is a fusion region between the taper 38*a* and the film 42. The taper 38*a* is easily fused when heated, so that the film 42 can be securely fused thereto. In addition, even when tolerance occurs in the top section of the annular projection 38 as viewed in plan view, the tolerance can be easily absorbed.

Meanwhile, on the under face 11*b* of the passage forming member 11, as shown in FIGS. 6B and 7, for example, an annular projection 35 having an outer shape similar to a paddle for rowing a boat is formed. The annular projection 35 is formed thinly and lengthily in the main scanning direction, and as viewed in plan view, surrounds the ink inlet hole 31 and the communication port 32. The annular projection 35 is formed such that the section thereof corresponding to the paddle shaft extends from the ink inlet hole 31 to the center of the passage area, and in continuation, widened section thereof corresponding to the paddle blade reaches the communication port 32. The widened section of the annular projection 35 has a substantially oval outer shape, and is slightly smaller than the width of the passage forming member 11. The top section of the annular projection 35, as shown in FIG. 7, is formed with a taper 35*a* similar to that of the annular projection 38. The flexible film 41 is fused onto the taper 35*a*, so that a passage 35*b* of the annular projection 35 is sealed. The section surrounded by the annular projection 35 and the film 41 becomes part of the ink passage 34. A hatched region illustrated in FIG. 6B is a fusion region between the taper 35*a* and the film 41.

Between the film 41 and the plate 12 to which the passage forming member 11 is fixed, a slight gap allowing bending of the film 41 is formed. Since the film thus serves as a damper, vibrations transferred by means of ink in the ink passage 34 are effectively attenuated. The film 42 is hardly bent due to its small planar area even though a pressure wave occurs in ink in the ink passage 34. The films 41 and 42 are flexible and are made of a material having a gas barrier (e.g., PET film coated with SiOx film or aluminum film).

As shown in FIGS. 5 and 6B, within the range surrounded by the annular projection 35, a recess 36 is formed. The recess 36 has a shape substantially similar to the widened section of the annular projection 35, and is slightly smaller than the widened section. The recess 36 is blocked by the filter 37 in which a number of micro holes are formed. The filter 37 divides the ink passage 34 into an upstream region including the ink inlet hole 31 and a downstream region including the communication port 32 and the communication hole 33. Ink is filtered by passing though the filter 37. In addition to the annular projection 35 of the under face 11*b*, ribs 29*a* and 29*b* are formed like the ribs 28*a* and 28*b* of the surface 11*a*. By these ribs 29*a* and 29*b*, the stiffness of the passage forming member 11 comes to be stronger.

Like this, the passage forming member 11 is provided with the ink passage 34 extending from the inlet port 31*a* to the outlet port 33*a*. In the vicinity of the outlet port 33*a* of the under face 11*b*, as shown in FIG. 5, an annular groove 43 is formed. Into the annular groove 43, an O-ring 44 is fitted. By the O-ring 44, the communication hole 33 and a through-hole 53 (which will be described later) of the plate 12 watertightly communicate with each other via the outlet port 33*a*.

Figure 6C:
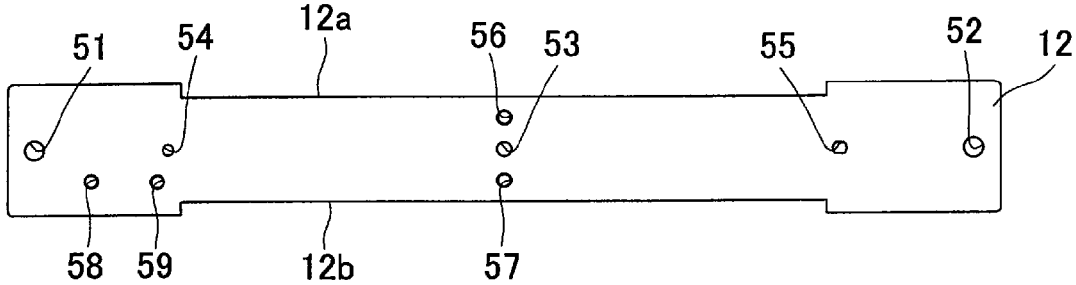

As shown in FIGS. 5 and 6C, the second layered plate 12 is provided with five through-holes 51 to 55 and four screw holes 56 to 59. Two through-holes 51 and 52 in the vicinity of the both ends in the main scanning direction are fixing holes of the ink-jet head 1 itself, and are used for building the head 1 in a printer main body. Central through-hole 53 of the plate is an ink passage 60 communicating with the communication hole 33 of the passage forming member 11. Two through-holes 54 and 55 disposed slightly toward the center rather than the through-holes 51 and 52 are used for positioning the three plates 12 to 14 upon lamination. The four screw holes 56 to 59 are formed corresponding to the through-holes 45 to 48 of the four passage forming members 11, and are used for fixing the plate 12 to the passage forming member 11.

Figure 6D:
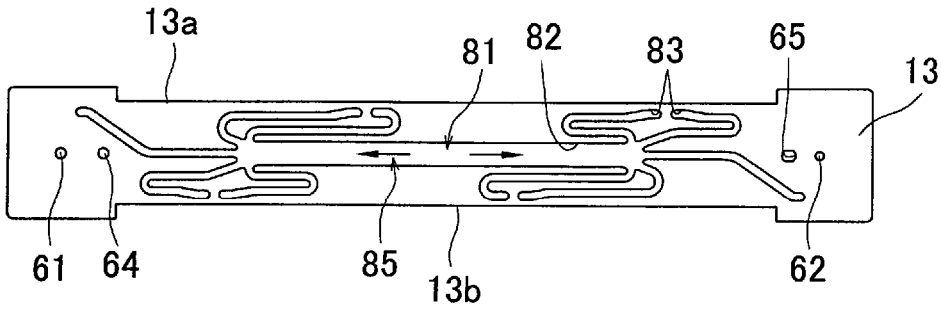

As shown in FIGS. 5 and 6D, the third layered plate 13 is provided with five through-holes 61, 62, 64, 65 and 81. The through-holes 61, 62, 64 and 65 are the through-holes for use in laminating and assembling the plates. The through-holes 61 and 62 are used in assembling the reservoir unit 3 and the passage unit 9 together. In assembling the ink-jet head 1, the reservoir unit 3 and the passage unit 9 are positioned by a positioning pin standing on an assembling plate. The through-holes 61 and 62 are an escape hole through which the top section of the positioning pin is escaped. Thus, the through-holes 61 and 62 have a diameter larger than through-holes 71 and 72 (positioning holes used in actual assembling) which will be described later. Meanwhile, the through-holes 64 and 65 are a positioning hole for positioning the plates upon lamination. The through-holes 64 and 65 are positioned corresponding to the through-holes 54 and 55 of the plate 12. A through-hole 81 forms a reservoir passage 85 as an ink reservoir for temporarily storing therein ink. The reservoir passage 85 consists of a main passage 82 and ten sub passages 83 communicating with the main passage 82. The main passage 82 communicates with the through-hole 53 of the plate 12 at the middle thereof and extends in the main scanning direction. The sub passages 83 are diverging passages diverging five by five from both ends of the main passage 82, and have substantially identical flow resistance.

Figure 6E:
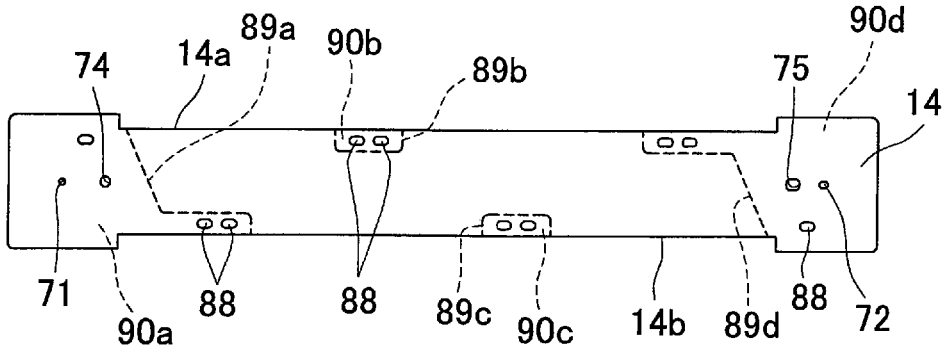

In the fourth layered plate 14, as shown in FIGS. 5 and 6E, four through-holes 71, 72, 74 and 75 and ten through-holes 88 are formed. The four through-holes 71, 72, 74 and 75 are also used in laminating and assembling the plates. The through-holes 71 and 72 are positioning holes for use in assembling the ink-jet head 1, and are disposed corresponding to the through-holes 61 and 62 of the plate 13. The through-holes 74 and 75 are positioning holes, and are disposed corresponding to the positioning holes 64 and 65 of the plate 13. The ten through-holes 88 are ink supply holes 88, and are formed confronting the leading ends of the sub passages 83 of the plate 13. The planar shape thereof is a substantially oval shape.

In the under face of the plate 14, a recess is formed. The recess confronts the installation positions of the four actuator units 21 disposed on the passage unit 9. On the contrary, the periphery of the through-holes 88 of the ink supply holes (denoted by the dotted line in the drawing) are formed with projections 89*a*, 89*b*, 89*c* and 89*d* protruding downward. The projections 89*a* and 89*d* and the projections 89*b* and 89*c* each have the same planar shape, and are point-symmetrically disposed with respect to the center of the plate 14. The leading ends (under face of the plate 14) of the projections 89*a* to 89*d* are fixed with a filter (not shown) disposed on the upper face 9*a* of the passage unit 9. In addition, the section other than the projections 89*a* to 89*d* is separated from the passage unit 9, and the FPC 6 is drawn out from a gap therebetween.

These three plates 12 to 14 are positioned by inserting the positioning pins, which are not illustrated in the drawings, into the positioning holes 54, 55, 64, 65, 74, and 75. The plates then are fixed each other by an adhesive. The passage forming member 11 is additionally screw-fixed to the plate 12. Then, the reservoir unit 3 in which the passage forming member 11 and three plates 12 to 14 are laminated is provided. The reservoir unit 3 and the passage unit 9 are bonded to each other by an adhesive after inserting the positioning pins into the escape holes 61 and 62 and the positioning holes 71 and 72.

As shown in FIGS. 6C, 6D and 6E, the three plates 12 to 14 each are provided with notches 12*a*, 12*b*, 13*a*, 13*b*, 14*a* and 14*b* which shorten the widths in the sub scanning direction of the plates 12 to 14. The notches 12*a*, 13*a* and 14*a* and the notches 12*b*, 13*b* and 14*b* each are overlapped in the lamination direction with each other. The width near the notches 12*a* to 14*b* (e.g., a under face distance between the notches 12*a* and 12*b*) is substantially equal to that of the passage forming member 11. The length of the notches 12*a* to 14*b* in its main scanning direction is equal to, or slightly larger than that of the heat sink 170 in its main scanning direction. Thus, when the reservoir unit 3 is fixed to the passage unit 9, the area of the passage unit 9 overlapped with the notches 12*a* to 14*b* in the lamination direction is exposed to outside. The exposed area is the area where the heat sink 170 is disposed.

Above the reservoir unit 3 and the passage unit 9, as set forth before, closed space is defined by the head cover 150 and the heat sink 170.

As shown in FIGS. 1 and 2, the head cover 150 has a box-like shape opened downward. The head cover 150 is installed on the plate 12, and covers the elements, such as the passage forming member 11, and the circuit board 4, which are disposed on the plate 12. At the sides of the head cover 150 facing each other in the sub scanning direction, a notch 151 is formed. The notch 151 has a shape of a rectangle. The long sides thereof extend in the main scanning direction. The short sides thereof are horizontally parallel with each other, and extend from the lower end of the side thereof toward the vicinity of the middle thereof. The notch 151 is blocked by the heat sink 170. The contact area among the head cover 150, the heat sink 170, the plate 12, and the passage unit 9 is sealed by sealing material. Thus, the closed space surrounded by these elements is formed.

Figure 9:
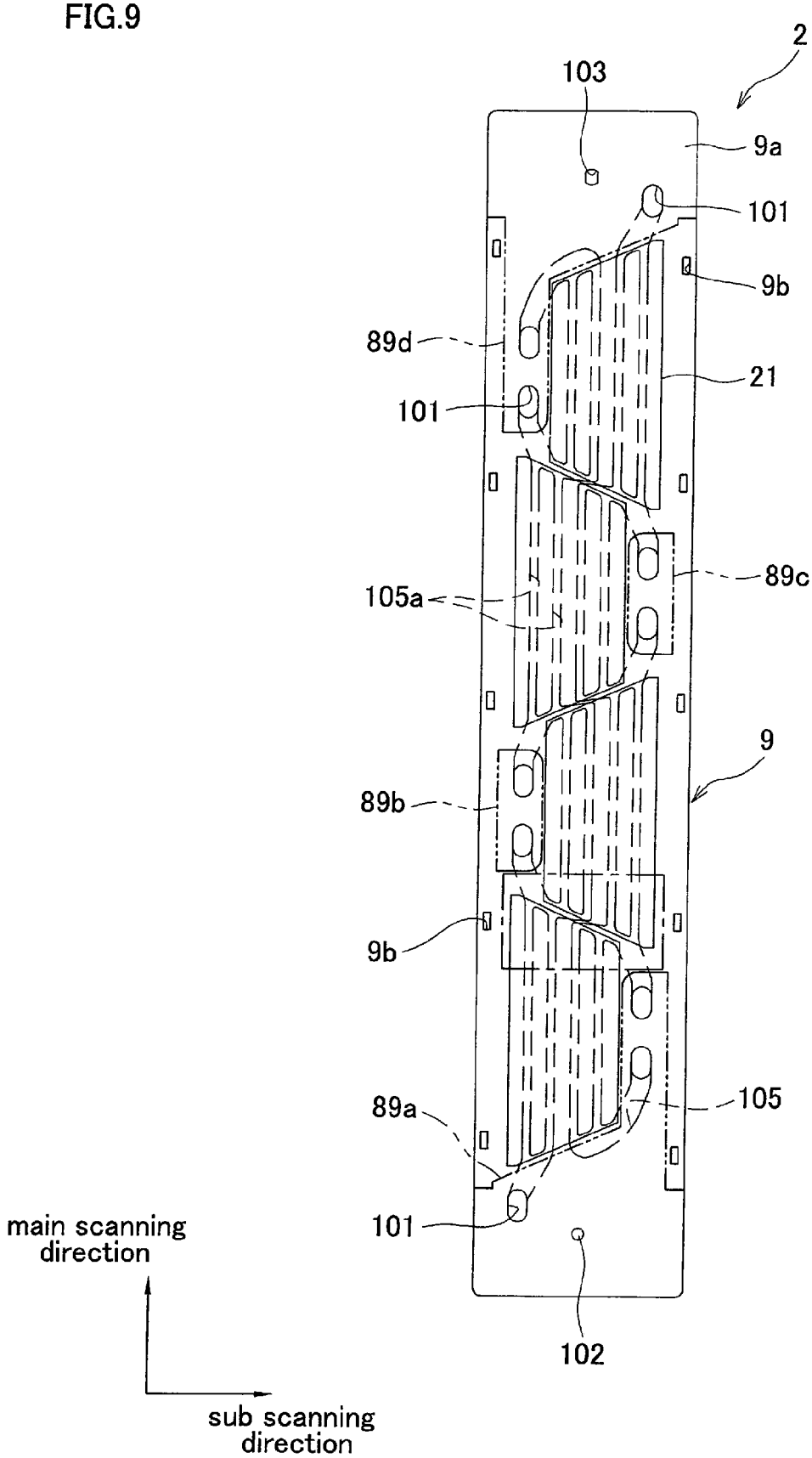
FIG. 9 is a plan view of a head main body.

Next, the above-mentioned heat sink 170 will be described in detail referring to FIG. 9. In FIG. 9, illustrated is the upper face of the passage unit 9 to which the heat sink 170 is attached.

As shown in FIG. 2, two heat sinks 170 are oppositely disposed in the vicinity of the opposite ends with respect to the sub scanning direction of the passage unit 9, so that they hold the reservoir unit 3 therebetween. The heat sink 170 protrudes from the upper face 9*a* of the passage unit 9. The two heat sinks 170 are made of aluminum, for example, and have a shape like a rectangle elongated in the main scanning direction. The heat sink 170 consists of a main part 171 and five projections 172.

The center area of the main part 171 faces the side of the passage forming member 11, and has the size and planar shape substantially identical to the notch 151. The center area of the main part 171 is surrounded by the periphery of the main part 171, and protrudes farther outside than the periphery. The center area and the periphery of the main part 171 all are flat. The main part 171 is formed by pressing part of the metallic plate. The main part 171 protruding at its center area is formed so that the stiffness of the heat sink 170 is made stronger.

The projection 172 protrudes downward from the lower end of the periphery of the main part 171. The five projections are formed along the main scanning direction. As set forth above, the reservoir unit 3 is provided with notches 12*a* to 14*b* corresponding to the position of the heat sink 170. Meanwhile, as shown in FIG. 9, in the upper face 9*a* of the passage unit 9, ten grooves 9*b* are formed. The grooves 9*b* are formed at positions corresponding to the positions of the ten projections 171 formed on the two heat sinks 170. The groove 9*b* has the size and shape suitable to exactly fit thereto the projection 172. With the fitting of the projections 172 into the grooves 9*b*, the heat sinks 170 are installed in the passage unit 9.

As shown in FIG. 2, the upper end of the heat sink 170 installed in the passage unit 9 has a height substantially equal to the circuit board 4. Thus, in the state where the head cover 150 and the heat sink 170 are attached, the electronic elements mounted on the circuit board 4, particularly the capacitor 5*b* is doubly protected from external force together by the ribs 28*a*. Moreover, the heat sink 170 shields the noise occurring from the six capacitors 5*b*. Thus, the other electronic elements in a printer are hardly malfunctioned due to the noise from the capacitor 5*b*.

Next, description will be made of the ink flowing in the reservoir unit 3. In FIG. 5, arrows indicate the ink flowing in the reservoir unit 3.

As indicated by the arrows in FIG. 5, ink introduced into the passage forming member 11 from the ink inlet hole 31 via the joint 30 flows horizontally along the film 41. Then, ink flows upward toward the filter 37 from the area confronting the filter 37, and passes through the communication port 32. Herein, since ink passes through the filter 37 from downside to upside, foreign particles contained in ink are caught by the filter 37, and at the same time, when ink flowing is stopped, the caught particles drop down from the filter 37 and are separated downward near the film 41. Thus, the filter 37 is not clogged. Ink passing through the communication port flows horizontally along the film 42, and when arriving at the communication hole 33, ink then flows downward. Ink discharged from the outlet 33*a* of the communication hole 33 then passes through the through-hole 53 and drops toward the reservoir passage 85. Then, as indicated by the arrows in FIG. 6D, ink flows to opposite sides from the center of the main passage 82 along the longitudinal direction of the passage. When arrived at the longitudinally opposite ends of the main passage 82, ink diverges and is introduced into the respective sub passages 83. Ink introduced into the respective sub passages 83 passes through the ink supply hole 88 and filter (not shown) and is introduced into an ink supply port 101 (See FIG. 9) formed in the upper surface 9*a* of the passage unit 9. Ink introduced into the passage unit 9, as described later, is distributed to a number of individual ink passages 132 communicating with a manifold passage 105. When arrived at nozzles 108 of end points of the respective individual in passages 132, ink then is discharging outside. Like above, the ink passages such as the ink passage 34 and the reservoir passage 85 are formed in the reservoir unit 3, so that ink is temporarily stored therein.

Figure 10:
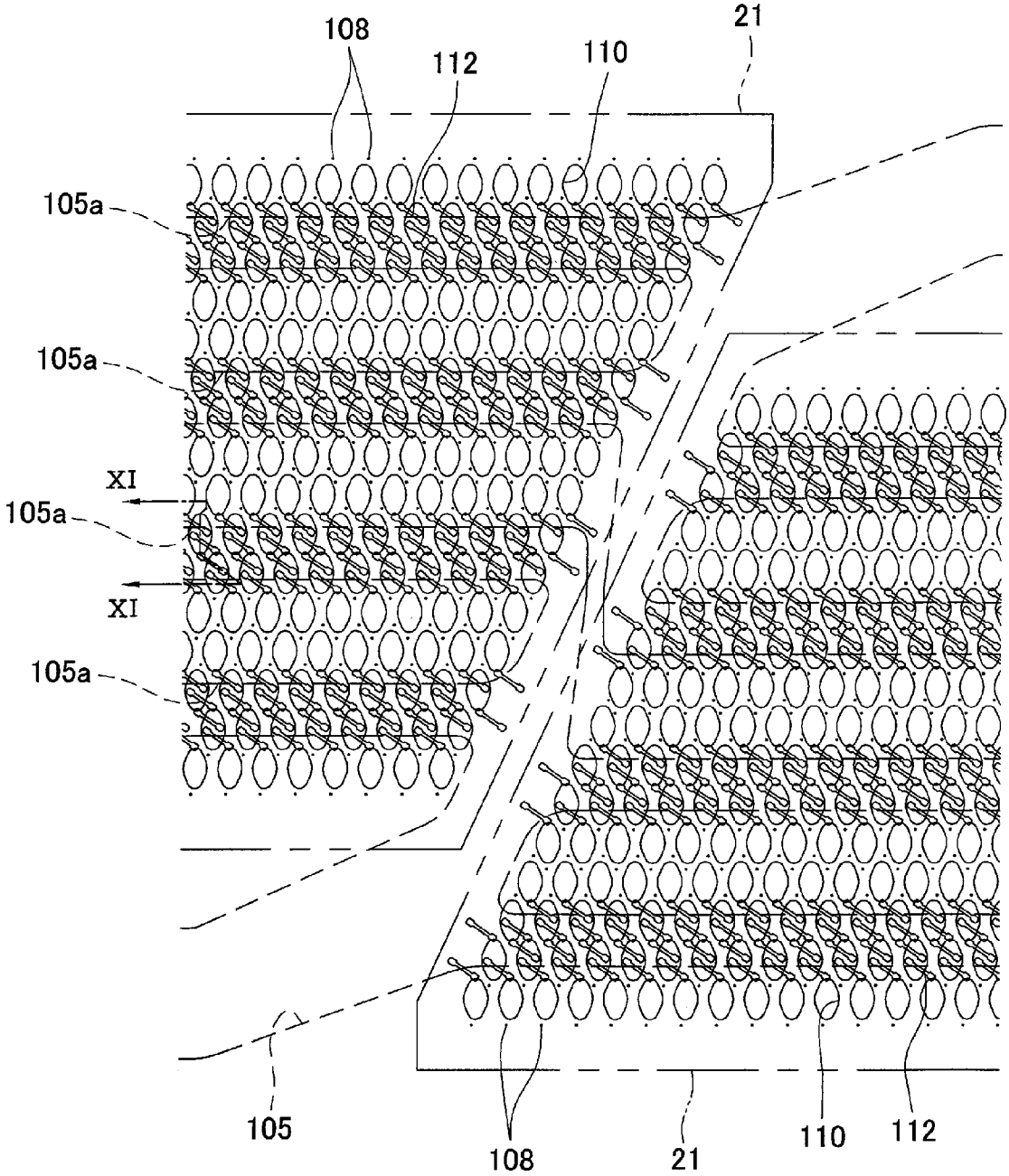
FIG. 10 is an enlarged view of an area indicated by the dashed dotted line in FIG. 9.

Next, the head main body 2 will be explained referring to FIGS. 9 to 12. In FIG. 10, while pressure chambers 110, apertures 112, and nozzles 108 should have been depicted by using a dotted line because they are positioned under the actuator unit 21, for the convenience of explanation, they are depicted by using a solid line.

As shown in FIG. 9, the head main body 2 includes the passage unit 9 and the four actuator units 21 fixed onto the upper surface 9*a* of the passage unit 9. in the actuator unit 21, many actuators are provided which are installed at each pressure chamber 110. The respective actuators have a function of providing ink in the pressure chambers formed in the passage unit 9 with ejection energy.

The passage unit 9 has a shape of a rectangular parallelepiped having a planar shape substantially identical to the plate 14 of the reservoir unit 3. The under face of the passage unit 9 is formed with an ink discharging face in which many ejection ports 108 are arranged in matrix. Similar to the ejection ports 108, the pressure chambers 110 are arranged in matrix at the fixing face between the passage unit 9 and the actuator unit 21. At both longitudinal ends of the passage unit 9, positioning holes 102 and 103 are formed corresponding to the escape holes 61 and 62 and the positioning holes 71 and 72 formed in the plates 13 and 14. With insertion of positioning pins through the escape holes 61 and 62 and the positioning holes 71, 72, 102 and 103, the passage unit 9 and the reservoir unit 3 are positioned.

As set forth above, on the upper surface 9*a* of the passage unit 9, five recesses 9*b* are provided to both ends, respectively, of the passage unit in the sub scanning direction along the main scanning direction. As mentioned above, the ten recesses 9*b* in total are shaped such that the projections 172 of the heat sinks 170 are exactly fitted thereto. The recesses 9*b* are formed in the area that exists in the notches 12*a*, 12*b*, 13*a*, 13*b*, 14*a* 14*b* as viewed in plan view, excluding the region contacting the top faces 90*a* to 90*d* (indicated by an alternated long and two short dashes line in the drawing) of the projections 89*a* to 89*d* of the plate 14 and the region to which the actuator unit 21 is fixed.

Figure 11:
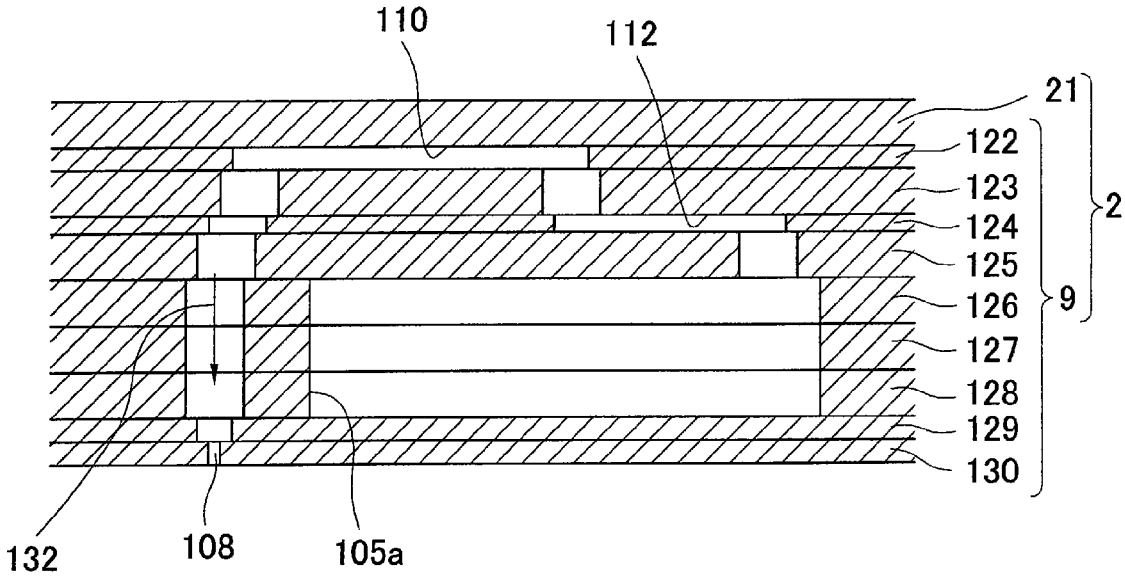
FIG. 11 is a partial sectional view taken along lines XI-XI illustrated in FIG. 10.

As shown in FIG. 11, the passage unit 9 consists of nine metal plates including a cavity plate 122, a base plate 123, an aperture plate 124, a supply plate 125, three manifold plates 126, 127, and 128, a cover plate 129, and a nozzle plate 130, which are disposed in the order named from upside. These plates 122 to 130 each have a rectangular planar shape that is long in the main scanning direction. Similar to the plates 12 to 14 of the reservoir unit 3, the respective plates 122 to 130 are made of SUS430. With the lamination of these plates 122 to 130 having through-holes, a number of individual ink passages 132 are formed in the passage unit 9, the ink passages extending from the manifold passage 105 to the ejection port 108 via the sub manifold passage 105*a*, the outlet port of the sub manifold passage, an aperture 112 as a tightening aperture, and the pressure chamber 110.

Returning to FIG. 9, on the upper face 9*a* of the passage unit 9, ten ink supply ports 101 in total are opened at positions corresponding to the ink supply hole 88 (See FIG. 6E) of the reservoir unit 3. In the passage unit 9, the manifold passage 105 communicating with the ink supply port 101 and the sub manifold passage 105*a* diverging from the manifold passage 105 are formed. Ink supplied from the reservoir unit 3 into the passage unit 9 via the ink supply port 101 is supplied from the manifold passage 105 to the sub manifold passage 105*a* to the ejection port 108 via the aperture 112 and the pressure chamber 110.

The four actuator units 21, as shown in FIG. 9, have a trapezoidal planar shape, and are arranged in zigzags so as to turn aside the ink supply port 101 and the recesses 9*b* opened in the upper surface 9*a* of the passage unit 9. The four actuator units 21 are arranged such that they are disposed at regular intervals opposite to each other with respect to the center of the width direction of the passage unit 9. The parallel confronting sides of the respective actuator unit 21 follow the longitudinal direction of the passage unit 9, and oblique sides of the adjacent actuator units 21 are overlapped with each other with respect to the longitudinal direction of the passage unit 9.

The actuator unit 21 is fixed to the section of the face 9*a* of the passage unit 9 which is separated from and confronts the under face of the reservoir unit 3. The reservoir unit 3 is fixed to the passage unit 9 in the projections 89*a* to 89*d*. Thus, between the reservoir unit 3 and the passage unit 9, a gap is formed as high as the protruding height of the projections 89*a* to 89*d*. The actuator unit 21 is disposed in the gap. Moreover, on the actuator unit 21, the FPC 6 is fixed. The FPC 6 does not come to contact with the under face of the reservoir unit 3.

Figure 12A:
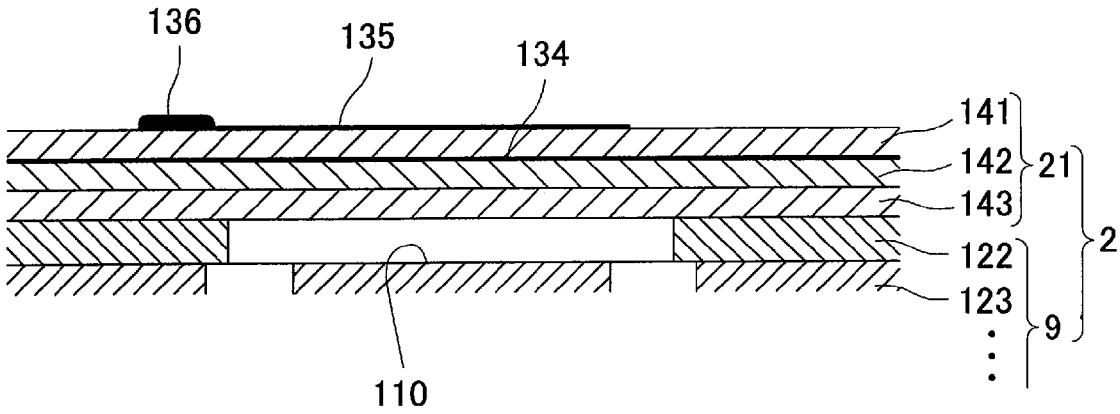
FIG. 12A is an enlarged sectional view of an actuator unit.

The actuator unit 21, as shown in FIG. 12A, consists of three piezoelectric sheets 141, 142, and 143 each being made of ferroelectric Lead Zirconate Titanate (PZT) based ceramics material and having a thickness of approximately 15 μm. The piezoelectric sheets 141 to 143 are so arranged as to be seated on the pressure chambers 110 formed corresponding to a single ink discharging face.

In a position corresponding to the pressure chambers on the uppermost piezoelectric sheet 141, the individual electrodes 135 are formed. Between the uppermost piezoelectric sheet 141 and the next layered piezoelectric sheet 142, a common electrode 134 formed in thickness of approximately 2 μm on the whole face of the sheet is interposed. The individual electrode 135 and the common electrode 134 all are made of metallic material such as, for example, Ag—Pd based material. An electrode is not disposed between the piezoelectric sheets 142 and 143.

Figure 12B:
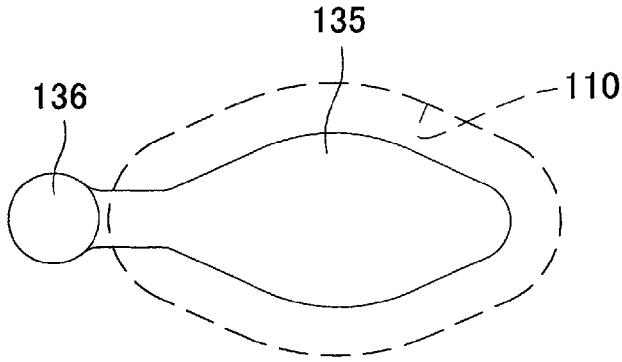
FIG. 12B is a plan view illustrating individual electrodes disposed on the surface of the actuator unit in FIG. 12A.

The individual electrode 135 has a thickness of approximately 1 μm, and, as shown in FIG. 12B, has a substantially trapezoidal shape in plan view, similar to the pressure chamber 110. An acute section of the substantially trapezoidal individual electrode 135 extends for its one end, the leading end of which is installed with a circular land 136 having a diameter of approximately 160 μm and connected with the individual electrode 135. The land 136 is made of gold containing, for example, glass flit. As shown in FIG. 12A, the land 136 is formed at a position that is on the extension of the individual electrode 135, and confronts a wall partitioning the pressure chamber 110 of the cavity plate 122 with respect to the thickness direction of the piezoelectric sheets 141 to 143, i.e., a position that is on the extension of the individual electrode, and is not overlapped with the pressure chamber 110. The land is electrically bonded with the wirings of the FPC 6.

The common electrode 134 is earthed to an area that is not shown. Thus, the common electrode 134 is kept at ground potential in the area corresponding to all pressure chambers 110. Meanwhile, the individual electrode 135 is connected to the driver IC 7 via the FPC 6, in which a wiring is independently included in each land 136, and the land 136, so as to selectively control electro-potential. That is, in the actuator unit 21, the section sandwiched between the individual electrodes 135 and the pressure chambers 110 serves as an individual actuator. On the contrary, the actuator unit 21 is provided with many actuators corresponding to the number of the pressure chambers 110.

Hereinafter, a driving method of the actuator unit 21 will be explained. The piezoelectric sheet 141 is polarized in its thickness direction. When an electric field is applied to the piezoelectric sheet 141 in its polarization direction while applying potential to the individual electrode 135 differently from the common electrode 134, the application section in the piezoelectric sheet 141 serves as an active layer that is distorted by piezoelectric effect. That is, the piezoelectric sheet 141 expands or contracts in its thickness direction, and expands or contracts in a planar direction by transversal piezoelectric effect. Meanwhile, the other two piezoelectric sheets 142 and 143 are an inactive layer that does not have an area interposed between the individual electrode 135 and the common electrode 134, and are not spontaneously deformed.

That is, the actuator unit 21 is one in so called unimorph type in which one piezoelectric sheet 141 farthest from the pressure chamber 110 is a layer including an active layer, and two piezoelectric sheets 142 and 143 closer to the pressure chamber 110 are an inactive layer. As shown in FIG. 12A, since the piezoelectric sheets 143 are fixed onto the upper surface of the cavity plate 122 that partitions the pressure chamber 110, when distortion in a planar direction occurs between a field application section in the piezoelectric sheet 141 and the piezoelectric sheets 142 and 143 below the former sheet 141, the piezoelectric sheets 141 to 143 are so deformed (unimorph deformation) as to be convex toward the pressure chamber 110 as a whole. Thus, the pressure chamber 110 is reduced in volume and a pressure in the pressure chamber 110 is raised, so that ink is drawn out from the pressure chamber 110 to the ink ejection port 108 and then is discharged outside from the ejection port 108. Then, when the individual electrode 135 returns to electro-potential equal to the common electrode 134, the piezoelectric sheets 141 to 143 return to their original flat shape, and the pressure chamber 110 also returns to its original volume. Thus, ink is introduced into the individual ink passage 132 from the sub manifold passage 105*a*, and then is stored in the pressure chamber 110. With above process, desired images are printed on the paper.

In the ink-jet head 1 according to the present embodiment, the capacitor 5*b* are substantially fully received in the recess 28*c*, so that it is prevented the capacitor 5*b* from being damaged and detached from the circuit board 4. Moreover, the ink-jet head 1 may be made smaller and narrower.

While the embodiment has illustrated that the recess area of the passage forming member 11 is not provided with a passage, it may be configured such that a joint identical to and confronting the joint 30 of the passage forming member 11 is provided, and a passage communicating between the former joint and the communication hole 33 is formed in the recess area. In this case, when part of the ribs 29*a* and 29*b* is formed as a passage, it is possible to discharge air entering upon ink introduction from the passage while obtaining the above-mentioned effect. In addition, while the embodiment has illustrated that only a single capacitor 5*b* is received in the recess 28*c*, six capacitors may be received in below six recesses 28*c*.

The under face 11*b* may not be provided with the ribs 29*a* and 29*b*. In this case, when the surface 11*a* is moved toward the plate 12 to thereby render the ribs 28*a* and 28*b* raised to the extent, it is possible to receive the taller capacitors in the recesses 28*c*. The protruding heights of the ribs 28*a* and 28*b* from the face 11*a* may be smaller than those of the capacitors 5*b* from the under face of the circuit board 4. In this case, the heights of the projections 27*a* to 27*c* of the passage forming member 11 may be made higher than those in the above-mentioned embodiment, thereby providing a gap between the top sections of the ribs 28*a* and 28*b* and the under face of the circuit board 4. With the above construction, heat generated from the capacitors 5*b* is effectively discharged outside from the recesses 28*c*, so that the stable operation of the electronic elements mounted on the circuit board 4 is secured. Such effect can be obtained also by providing the sides of the ribs 28*a* and 28*b* defining the recesses 28*c* with notches or through-holes communicating with the neighboring recesses 28*c*. It is preferable that such notches or through-holes be formed within the range that the stiffness of the passage forming member 11 is not excessively reduced. In addition, regards making the ink-jet head compact, the capacitors 5*b* may not be surface-mounted on the circuit board 4, but may be simply mounted on the circuit board.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet head comprising:

a first passage forming member elongated in one direction and having an ink inlet port in the vicinity of one longitudinal end thereof, an ink outlet port in the middle section in the longitudinal direction thereof, and a first ink passage extending from the ink inlet port to the ink outlet port, the ink inlet and outlet ports being open in first and second directions opposite to each other, respectively;

a second passage forming member having therein a second ink passage connected to the first ink passage via the ink outlet port; and a circuit board disposed at a position where the first passage forming member is sandwiched between the circuit board and the second passage forming member with respect to the first direction, an electronic element being mounted on the circuit board, wherein a projection defining a recess opened in the first direction is formed on a surface of the first passage forming member, the surface being at least between the other longitudinal end thereof and the middle section thereof and facing the circuit board, and wherein the electronic element is mounted on position facing the recess of the circuit board, and is received therein.

2. The ink-jet head according to claim 1, wherein one or more electronic elements are respectively disposed on a first face of the circuit board facing the first passage forming member and a second face opposite to the first face, and wherein among the plurality of electronic elements, the tallest electronic part that has the largest protruding height from either first and second faces is mounted on the first face at a position facing the recess.

3. The ink-jet head according to claim 2, wherein the projection is an annular projection surrounding the recess, and wherein the protruding height of the annular projection from the surface is larger than that of the tallest electronic element from the first face.

4. The ink-jet head according to claim 3, wherein the first face of the circuit board is in contact with the projection.

5. The ink-jet head according to claim 1, wherein the electronic element is surface-mounted on the circuit board.

6. The ink-jet head according to claim 1, wherein an ink passage is not formed between the other longitudinal end and the middle section of the first passage forming member.

* * * * *